United States Patent [19]

Fields

[11] Patent Number: 4,535,250

[45] Date of Patent: Aug. 13, 1985

[54] CONTAINER FOR RADIOACTIVE MATERIALS

[75] Inventor: Stanley R. Fields, Richland, Wash.

[73] Assignee: The United States of America as represented by the United States Department of Energy, Washington, D.C.

[21] Appl. No.: 615,210

[22] Filed: May 30, 1984

[51] Int. Cl.[3] ..... G21C 19/40

[52] U.S. Cl. ..... 250/507.1

[58] Field of Search ..... 250/507.1, 506.1

[56] References Cited

U.S. PATENT DOCUMENTS 4,414,475 11/1983 Kratz ..... 250/507.1

FOREIGN PATENT DOCUMENTS 2433816 4/1980 France ..... 250/507.1

0793448 10/1964 United Kingdom ..... 250/506.1

*Primary Examiner*—Sam Silverberg

*Attorney, Agent, or Firm*—Edward W. Nypaver; Robert Southworth, III; Judson R. Hightower

[57] ABSTRACT

A container for housing a plurality of canister assemblies containing radioactive material and disposed in a longitudinally spaced relation within a carrier to form a payload package concentrically mounted within the container. The payload package includes a spacer for each canister assembly, said spacer comprising a base member longitudinally spacing adjacent canister assemblies from each other and a sleeve surrounding the associated canister assembly for centering the same and conducting heat from the radioactive material in a desired flow path.

15 Claims, 7 Drawing Figures

CONTAINER FOR RADIOACTIVE MATERIALS

The U.S. Government has rights in this invention pursuant to Contract No. DE-AC06-76FF02170 between the U. S. Department of Energy and the Westinghouse Electric Corporation.

BACKGROUND OF INVENTION

This invention relates generally to a container and, more particularly, to a container for shipping and storing radioactive materials.

In view of the many hazards and problems associated with the management of radioactive materials, numerous Federal Regulations have been promulgated governing the handling of such materials. Regulations controlling the transport and storage of radioactive materials have been established to prevent the loss or dispersal of material during shipment and to ensure the safety of the public as well as the transportation workers involved. Basically, such materials must be transported in packages or containers which shall prevent loss or dispersal of the contents, retain shielding efficiency, assure nuclear criticality safety, and provide adequate heat dissipation under both normal transport and hypothetical accident conditions.

Many fuel storage and shipping containers, conforming to the requirements of the Regulations, have been developed to safely transport radioactive materials. While such containers admirably serve the purpose for which they were designed, they possess certain disadvantages. For example, these containers generally include an inner, central canister defining a cavity for containing the radioactive material, an annular radiation shielding filler surrounding the canister and which usually occupies substantially more space than the radioactive material, an outer shell encapsulating the layer of nuclear shielding, and heat rejecting fins projecting outwardly from the outer shell. Thus, the overall package occupies a substantially large volume compared to the relatively small volume of the contained radioactive material, resulting in a huge package for housing a relatively small, and thereby expensive and inefficient, payload.

Also, the thermal transfer of heat generated by the radioactive material poses problems, especially with the pressure seals employed to provide an airtight containment. It has been found that conventional seals, usually formed of polyvinyl chloride or polyethylene, deteriorate at about 250° F. and are rendered ineffective. Thus, the seal temperatures dictate the upper temperature limitations permissible within the container. Another disadvantage with conventional containers is that they are not always compatible with remote handling apparatus, nor with the more recently developed automated processes employed in the fabrication of nuclear fuels.

Accordingly, it is a primary object of the present invention to obviate the above noted shortcomings by providing a new and improved shipping container for housing a plurality of canister assemblies containing radioactive material in an optimum payload configuration or package.

It is another object of this invention to provide a container for shipping or storing radioactive material in conformance with present day Federal Regulations.

It is still another object of the present invention to provide the foregoing container with a heat transfer arrangement maintaining the internal temperatures of the container well within tolerable levels.

It is a further object of this invention to provide a shipping container especially compatible with automated remote handling means.

These and other objects, advantages, and characterizing features of the present invention will become clearly apparent from the ensuing detailed description of an illustrative embodiment thereof, taken together with the accompanying drawings wherein like reference characters denote like parts throughout the various views.

SUMMARY OF THE INVENTION

A shipping container for carrying a plurality of canister assemblies, each containing radioactive material. The several canister assemblies are stacked in a longitudinally spaced relation within a carrier or basket forming a payload package mounted concentrically within the container. The payload package includes for each canister assembly a spacer comprising a base member longitudinally spacing adjacent canister assemblies from each other and a heat conducting sleeve surrounding the associated canister assembly.

DETAILED DESCRIPTION OF THE PREFERRED EMBODIMENT

Figure 1:
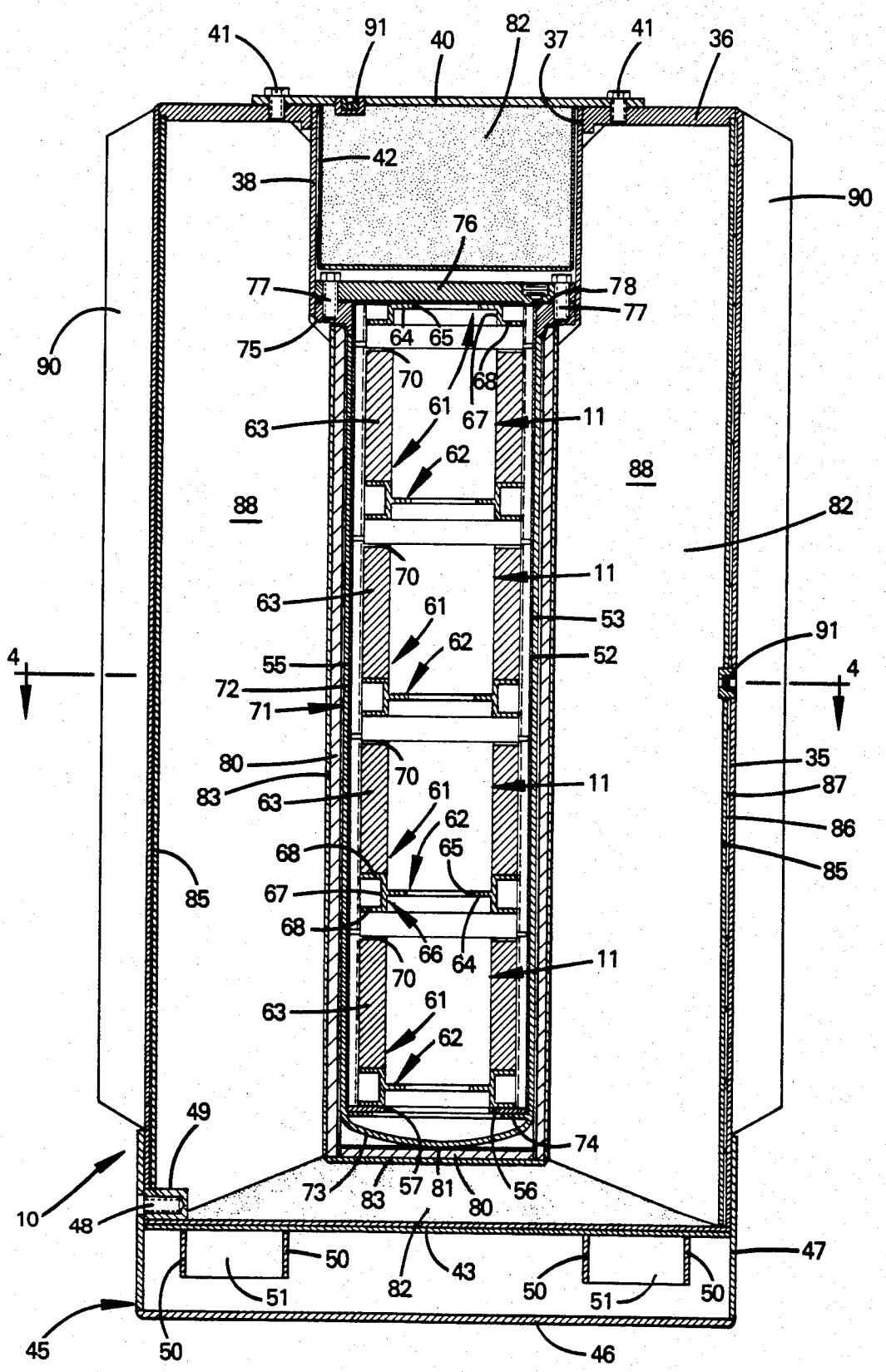
FIG. 1 is a longitudinal sectional view of a shipping and storage container constructed in accordance with the principles of this invention.

Referring now in detail to the illustrative embodiment depicted in the accompanying drawings, there is shown in FIG. 1 a cask or shipping container, comprehensively designated 10, adapted to house a plurality of canister assemblies 11 containing radioactive material. Although the container 10 will be commonly referred to as a "shipping container", it should be understood that it serves the function of storing radioactive material as well as safely transporting the same. While four such canister assemblies 11 are shown in the embodiment depicted in FIG. 1, it should be understood that more or less than four such assemblies 11 can be housed in the container 10, as desired. These canister assemblies 11 are especially suited for the containment of Special Nuclear Materials (SNM), such as plutonium oxide ($PuO_2$) nuclear fuel powder for example, but can be utilized for the shipment or storage of any radioactive material.

Figure 2:
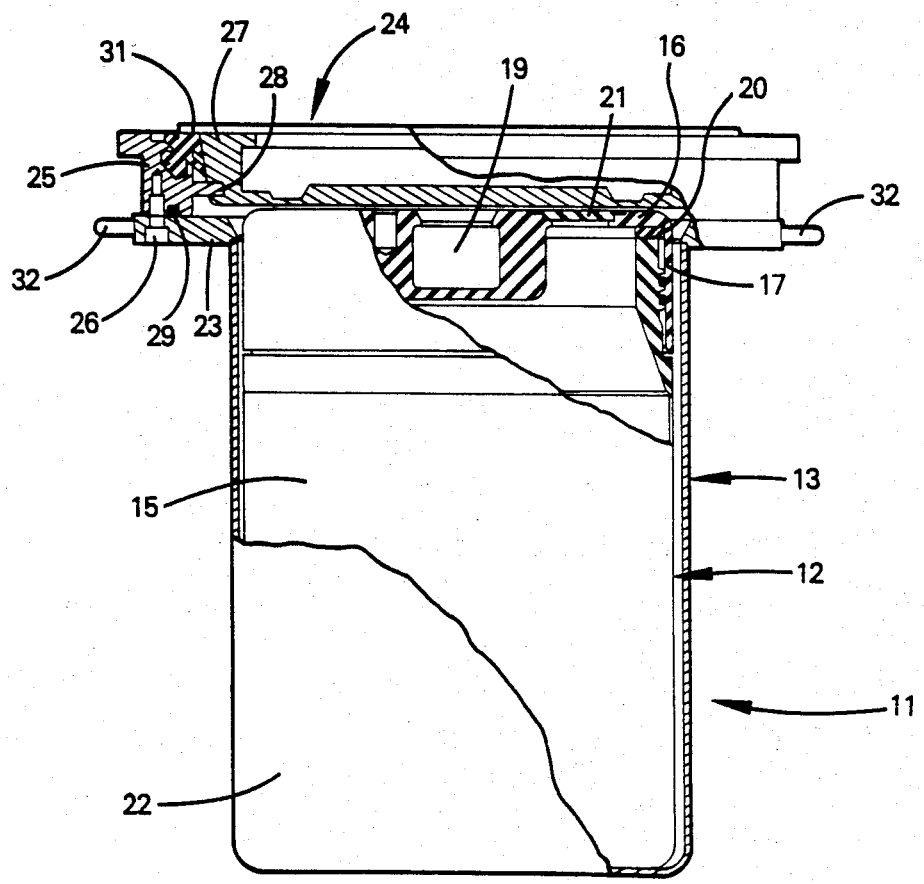
FIG. 2 is a front elevational view, partly in section and partly cut away for clarity, of an inner-outer canister assembly adapted to be shipped and stored in the container of FIG. 1.

Each of the canister assemblies 11 is constructed in a manner facilitating the manipulation thereof by remote handling apparatus, such as robots, grappling tools and the like. As shown in FIG. 2, each canister assembly 11 includes an inner canister 12 snugly nested within an outer canister 13. The inner canister 12, which is a contaminant containment barrier, comprises a cup-shaped, cylindrical body 15 for containing a desired volume of radioactive material and is closed by a removable lid 16 having a cylindrical threaded skirt 17 engagable with the upper threaded portion 18 of body 15. The lid 16 is formed with a central socket 19 for receiving the plug of a suitable remote handling grapple (not shown). A seal 20 is interposed between the upper end of the body 15 and lid 16 to provide pressure sealing therebetween. The canister 12 is vented by means of a five micron absolute filter 21 provided in the lid 16.

Figure 3:
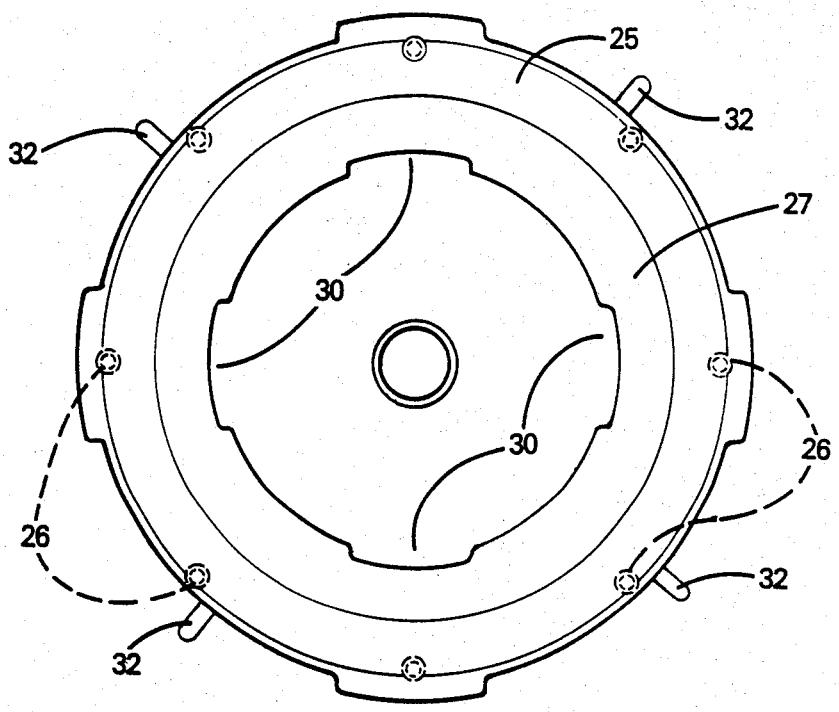
FIG. 3 is an end elevational view of the canister assembly shown in FIG. 2.

The outer canister 13 comprises a cup-shaped body 22 having an integral, outturned flange 23 at its open end for supporting an end cap or lid, generally designated 24. The lid 24 includes an outer rim 25 rigidly secured to flange 23, as by suitable fasteners 26, and an inner rotatable closure member 27 removably attached to the outer rim 25 by a slot and lip arrangement 28. An annular O-ring seal 29 is provided between the flange 23 and rim 25 to provide pressure sealing therebetween. The closure member 27 is formed with recessed portions 30 (FIG. 3) along the inner periphery thereof for the reception of an appropriate grappling tool (not shown). An annular seal 31 of a specially configurated shape in cross section is interposed between the mating surfaces of rim 25 and closure 27 to form an air tight seal therebetween. A series of spring-loaded pins 32 at circumferentially spaced distances about the periphery of rim 25 project radially outwardly therefrom. The outer canister 13 also is vented by a five micron absolute filter (not shown).

The seals 20, 29 and 31 preferably are formed of silicone rubber capable of withstanding temperatures substantially greater than the conventional polyvinyl chloride and polyetheylene seals which tend to deteriorate at temperatures of about 250° F. when subjected to such temperatures for a short period of time. While the silicone rubber seals can tolerate temperatures substantially greater than 250° F., this latter temperature is utilized as an upper limitation to provide a wide safety margin. It is a feature of this invention, as will hereinafter be more fully described, to provide means within container 10 for dissipating the decay heat generated by the radioactive material to maintain the seal temperatures at a level well below 250° F.

The shipping container 10 comprises a cylindrical housing or outer shell 35 formed of stainless steel to inhibit or prevent corrosion. The upper end of the shell 35 is provided with a circular top plate 36 welded or otherwise fixedly secured to shell 35 and formed with a central opening 37 therein to provide access to the interior of shell 35. A cylindrical support segment 38 projects downwardly from plate 36 and is welded adjacent its upper end to the peripheral edge defining the opening 37. The opening 37 is closed by a plate 40 rigidly secured to the plate 36 by suitable fasteners 41. A cup-shaped member or liner 42 is affixed to the underside of plate 40 for receiving a suitable neutron shielding material, as will hereinafter be described.

The lower end of shell 35 is closed by a bottom wall 43 forming a part of a support pallet 45 having a base 46 and a cylindrical skirt 47 overlying the lower end of shell 35 and secured thereto by fasteners 48 threaded into tapped openings formed in anchor members 49 affixed to the outer shell 35. Two pairs of laterally spaced structural members 50 extend downwardly from the bottom wall 43 to define openings 51 for receiving the lift elements of a fork lift apparatus (not shown) to facilitate handling of the container 10.

Figure 4:
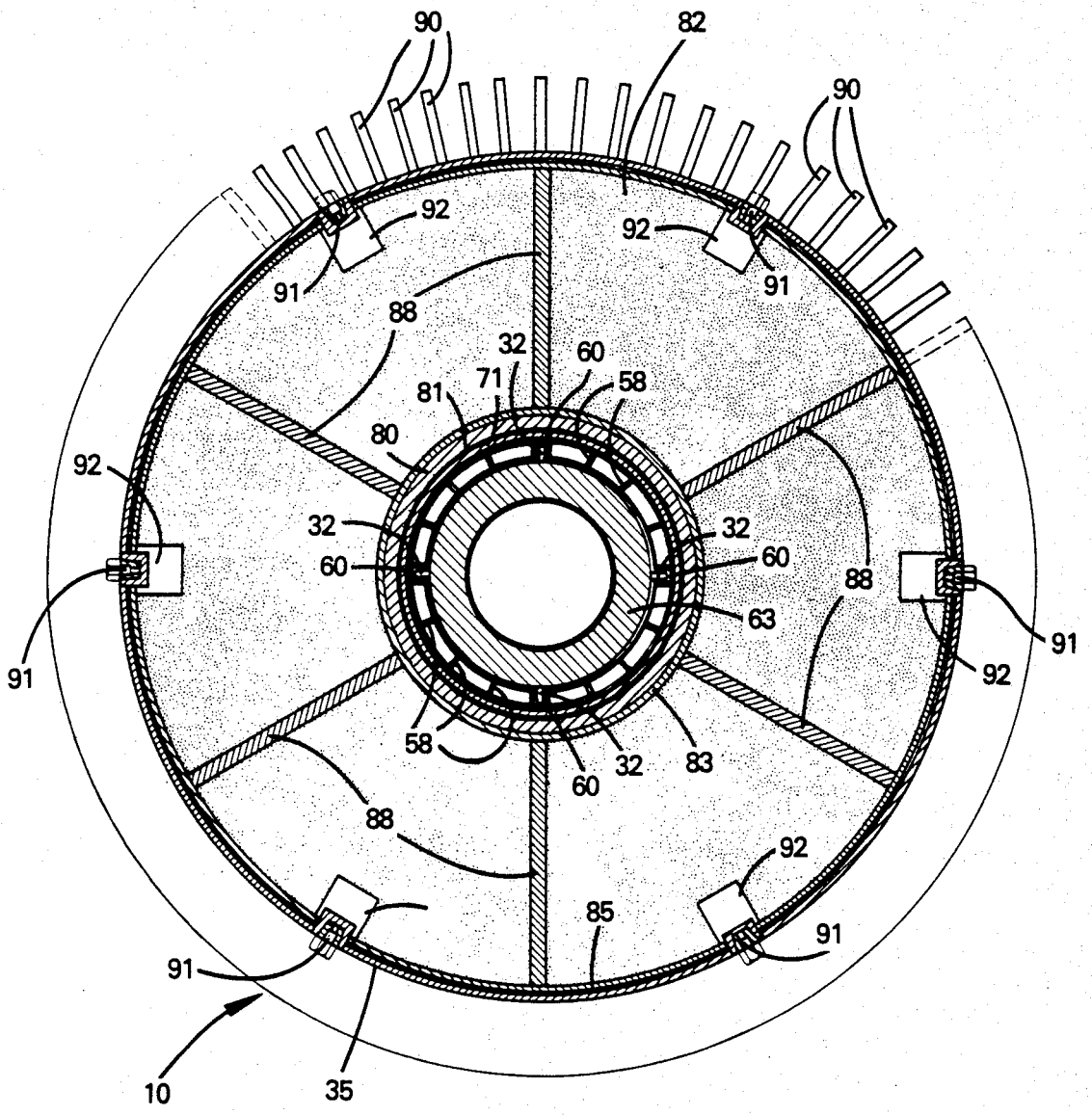
FIG. 4 is a cross sectional view, taken along the line 4—4 of FIG. 1.

It is a feature of this invention to arrange the several canister assemblies 11 in a vertically or longitudinally stacked, but spaced, relation within the shell 35 in a concentric relation therewith by means of a carrier or basket 52 to form an optimum payload configuration or package, comprehensively designated 53. The cylindrical basket 52 is formed with an annular side wall 55 extending lengthwise of the several canister assemblies 11 and terminating at its lower end in a circular bottom plate 56 having a central opening 57 therethrough. The side wall 55 is formed of a pair of radially spaced apart members having circumferentially spaced ribs or fins 58 (FIG. 4) disposed therebetween to assist in conducting heat away from the canister assemblies 11. A series of longitudinal slots 60 are formed in the inner member of wall 55 to accommodate the pins 32 extending radially outwardly from the flange of each canister assembly 11.

Figure 5:
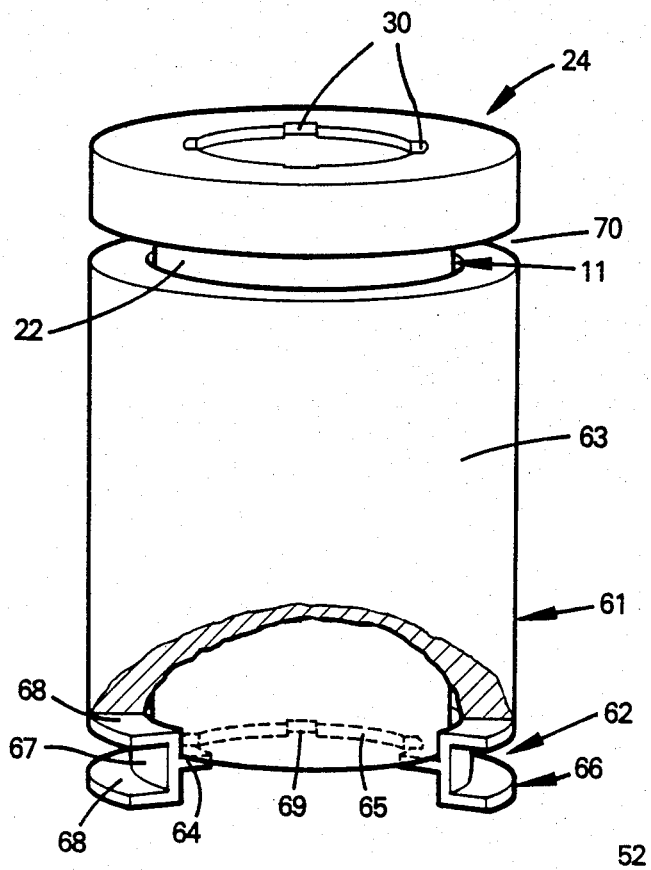
FIG. 5 is a perspective view, partly broken away, showing a canister assembly in association with a spacer utilized in the container of FIG. 1.
Figure 6:
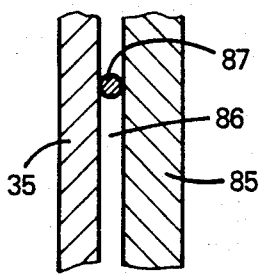
FIG. 6 is a fragmentary longitudinal sectional view of the outer shell of the container of FIG. 1.

Also forming a part of the payload package are a plurality of spacers, generally designated 61, equal in number to the number of canister assemblies 11 carried in the basket 52. The several spacers 61 are identical in construction and each comprises a base member 62 and a spacer sleeve 63 welded or otherwise fixedly secured to the base 62. The base member 62 serves to vertically space the lowermost canister assembly 11 from the bottom plate 56 of basket 52 and adjacent canister assemblies 11 from each other in their stacked relation within basket 52. Each base member 62 is formed with a circular supporting web 64 having a central access opening 65 therein and an annular rim 66 comprised of a vertically extending annulus 67 and a pair of flanges 68 extending radially outwardly from the opposite edges of the annulus 67. As best shown in FIG. 5, recesses 69 are formed in the opening 65 for accommodating a suitable grappling tool for the placement or removal of the spacer 61 into or from basket 52 in the same manner as a canister assembly 11. The uppermost spacer 61' does not include a sleeve 63 and is formed with an annulus 67' having a height only half the height of the other annuli 67 and a single flange 68' extending radially outwardly therefrom. This spacer 61' rests on the uppermost canister assembly 11 to complete the payload package 53.

In the stacked relation, each canister assembly 11 rests on the base member web 64 of its associated spacer 61 with the sleeve 63 thereof encircling the canister body portion 22. The sleeve 63, which has an outside diameter approximating the outside diameter of the canister lid 24, centers the canister assembly 11 within basket 52 and also serves to conduct heat radially away from the canister assembly 11. In this stacked relation, an annular air gap 70 (shown exaggerated in FIG. 5) is provided between the top of each spacer sleeve 63 and lid 24 of the associated canister assembly 11 to inhibit vertical heat conduction from the canister and sleeve upwardly toward the seal areas in lid 24.

The basket 52 is retained within a pressure vessel 71 formed of stainless steel and comprising a cylindrical shell 72 and a bottom end wall 73. An annular shelf 74, formed integral with the shell 72, extends inwardly therefrom for supporting the basket 52 and thereby the payload package 53. The upper end of shell 72 is formed with a flange 75 secured to a closure plate 76 by suitable fasteners 77. A compressible gasket 78 is sandwiched between the shell flange 75 and plate 76 to provide a fluid tight enclosure. The shell 72, end wall 73, flange 75 and closure plate 76 constitute the pressure vessel which completely encases the payload package.

Figure 7:
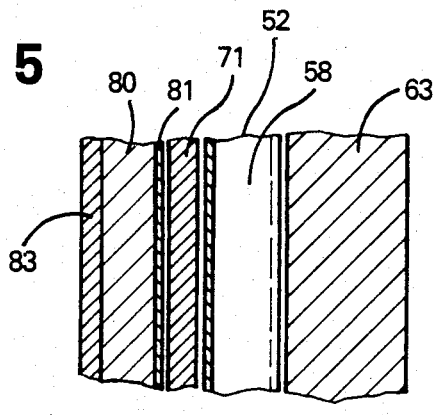
FIG. 7 is a fragmentary longitudinal sectional view, showing details of the interior of the container of FIG. 1.

A gamma shield 80, formed of lead, surrounds the shell 72 and bottom wall 73 of the pressure vessel 71 for containing the gamma rays emitted from the radioactive material contained in assemblies 11. This gamma shield 80 is provided with a relatively thin inner liner 81 (FIG. 7) formed of carbon steel and which is suitably bonded to the inner surface of the gamma shield 80. The liner 81 serves to reinforce the gamma shield 80 and provides additional structural strength thereto.

Surrounding the gamma shield 80 and filling the space between the latter and the outer shell 35 is a neutron shield 82, preferably formed of a shielding material available under the trademark RICORAD manufactured by Reactor Experiments Incorporated of San Carlos, Calif. The neutron shield 82 is provided with an inner liner 83 of carbon steel juxtaposed against the outer surface of the gamma shield 80 and an outer liner 85 of carbon steel disposed in slightly spaced relation to the outer shell 35. The spacing between outer liner 85 and shell 35 defines an annular air gap 86. This air gap 86 serves as a fire shield providing a thermal insulator or barrier in the event of a hypothetical thermal accident and meets the requirements specified under the Code of Federal Regulations for a container to withstand an elevated temperature of 1,475° F. for a period of 30 minutes. A wire 87 is wrapped in helical fashion about the outer liner 85 to maintain the desired clearance or air gap 86 between shell 35 and liner 85.

The lower space between the container bottom wall 43 and gamma shield 80 also is filled with neutron shielding 82 interposed between an inner liner 83 and an outer liner 85 contiguous with the container bottom wall 43. Also, neutron shielding material 82 is provided above the payload package 53 in the cup-shaped member 42, which serves as a liner for the shielding material.

While lead and the material designated under the trademark RICORAD are the preferred materials utilized in the gamma and neutron shields, respectively, of the container of this invention, it should be understood that other suitable materials having similar gamma and neutron absorption properties may be employed in lieu of the selected materials, if desired, within the purview of this invention. These shielding materials also possess thermal conductive properties facilitating the passage of heat under normal conditions from the canister assemblies 11 to the outer shell 35.

In order to further enhance the conduction of heat away from the payload package 53, a plurality of fins 88 are embedded in the material of the neutron shield 82 and extend radially between the neutron shield inner and outer liners 83 and 85. These fins 88 extend substantially lengthwise of the shipping container 10 and direct the heat flowing through the neutron shield to and through such fins. It has been found that approximately 96% of the heat transmitted through the neutron shield flows through fins 88.

The heat transmitted to the outer shell 35 is dissipated through a multiplicity of fins 90 extending substantially lengthwise of the shell 35 and projecting radially outwardly therefrom at circumferentially spaced distances about the entire periphery of shell 35. Such fins 90 significantly increase the surface area of container 10 from which thermal energy can be efficiently rejected through radiation, conduction, or convection.

As earlier noted, a critical problem encountered in the storage and transport of Special Nuclear Materials (SNM) is the generation of decay heat by such radioactive materials. Especially critical temperatures are those of the seals in the inner and outer canister lids 16 and 24. While the silicone rubber of which the several seals are formed is capable of withstanding temperatures greatly in excess of 250° F., a temperature limitation of 250° F. was imposed in order to provide a liberal safety factor for the seals. The container 10 of this invention addresses this problem by utilizing means for maintaining the internal temperature of the container below such limit while meeting shielding and criticality requirements imposed by Federal Regulations. Such means define a heat flow path conducting heat from the payload package 53 radially outwardly toward the outer shell 35 rather than vertically toward the several seal areas. This flow path includes the spacer sleeves 63, the double-wall and fin construction of basket 52, the gamma and neutron shields 80 and 82, the internal radial fins 88 extending through the neutron shield 82, and the external radial fins 90 projecting outwardly from the container shell 35. Thus, heat is conducted radially away from the payload package 53 and ultimately dissipated into the environment by the external heat rejecting fins 90. At the same time, heat flow vertically from the canister assemblies 11 is retarded by the vertical air spaces effected by the base members 62 of spacers 61 and the air gaps 70 provided between each spacer sleeve 63 and the lid 24 of its associated canister assembly 11. As a result of the thermal transfer arrangement described above, temperatures were found to average about 208° F. at the seal areas, well below the design limitation of 250° F.

In order to relieve pressure that might otherwise develop within the container 10 if vapor is released from the outer surface of the neutron shield 82 during an unlikely, but hypothetical, thermal accident, six fusible plugs 91 (FIG. 4) are mounted in circumferentially spaced intervals in the outer shell 35. These plugs 91 are formed of a material adapted to melt within a given temperature range, say from 225° F. to 255° F., to vent any neutron shield vapors that might be generated. The plugs 91 extend through the neutron shield outer liner 85 and are surrounded by fire shields 92 to prevent direct exposure of the neutron shield to the radiant environment when the fusible material melts. A similar fusible plug 91 also is provided in the container closure plate 40.

Loading or unloading of the canister assemblies 11 and spacers 61 is facilitated by the identical grappling recesses 30 and 69 formed in the canister assemblies 11 and spacers 61, respectively. Thus, the grappling tool is inserted through the recesses to alternately load or remove the assemblies 11 and spacers 61 one at a time. This arrangement is especially suited to the remote loading and unloading of the several canister assemblies 11 forming the payload package 53.

From the foregoing, it is apparent that the objects of the present invention have been fully accomplished. As a result of this invention, a new and improved shipping container, meeting all the requirements of the Federal Regulations as to integrity, shielding efficiency and criticality safety, is provided for housing a plurality of nuclear fuel canister assemblies to obtain optimum loading of radioactive material therewithin. By the provision of a novel carrier or basket and spacer arrangement located concentrically within the container, the several canister assemblies are stacked in a vertically spaced relation and radially surrounded by a heat transfer and nuclear shielding arrangement to enhance heat conduction radially outwardly toward the outer shell of the container while inhibiting deleterious heat flow vertically to the seal areas of the canister assemblies. Moreover, the construction arrangement of the payload package facilitates smooth and easy loading and unloading of the individual canister assemblies by remote handling means.

The foregoing description of a preferred embodiment of this invention has been presented for purposes of illustration and description. It is not intended to be exhaustive or to limit the invention to the precise form disclosed, and obviously many modifications and variations are possible in light of the above teaching. The embodiment was chosen and described in order to best explain the principles of this invention and its practical application to thereby enable others skilled in the art to utilize the invention in various embodiments and with various modifications as are suited to the particular use contemplated. It is intended that the scope of the invention be defined by the claims appended hereto.

I claim:

1. A container for shipping and storing radioactive material comprising: an outer shell, an inner payload package mounted concentrically within said shell, a radiation shielding material interposed between said pay load package and said shell, said payload package comprising a basket for housing a plurality of canister assemblies containing said radioactive material, said basket comprises a side wall and an end wall supporting alternate canister assemblies and spaces in a stacked relation therein thin, said canister assemblies arranged in a longitudinally spaced relation, a plurality of spacers associated with said canister assemblies, respectively, each spacer having a base member longitudinally spacing adjacent canister assemblies and a sleeve portion surrounding said associated canister assembly wherein said base of each spacer comprises a web portion for supporting a canister assembly and a peripheral rim of thickness adapted to rest on an adjacent canister assembly, said web having a central access opening there through.

2. A container according to claim 1, wherein said side wall comprises a pair of spaced apart members having ribs interposed therebetween.

3. A container according to claim 1, wherein said sleeve portion forms an axial extension of said rim.

4. A container according to claim 1, including a pressure vessel encasing said payload package.

5. A container according to claim 4, including radiation shielding material interposed between said pressure vessel and said outer shell.

6. A container according to claim 5, including a thermal barrier between said shielding material and said outer shell.

7. A container according to claim 6, wherein said thermal barrier comprises an air gap spacing said shielding material from said outer shell.

8. A container according to claim 7, including means in said gap for maintaining said spacing between said shielding material and said outer shell.

9. A container according to claim 1, including means for conducting heat away from said payload package.

10. A container according to claim 9, wherein said heat conducting means includes a plurality of radial fins interposed between said payload package and said outer shell and extending substantially lengthwise of said container.

11. A container according to claim 1, including a multiplicity of laterally spaced fins extending substantially lengthwise of said outer shell and projecting radially outwardly therefrom.

12. A container according to claim 5, wherein said radiation shielding material comprises a gamma shield surrounding said pressure vessel and a neutron shield disposed about said gamma shield.

13. A container according to claim 12, wherein said neutron shield is provided with an outer liner slightly spaced from said outer shell to define a thermal insulating gap therebetween, and means in said gap for maintaining the proper spacing between said outer liner and said outer shell.

14. A container according to claim 13, including means for conducting heat away from said payload package, said heat conducting means including a plurality of radial fins extending through said neutron shield, and a multiplicity of laterally spaced fins extending substantially lengthwise of said outer shell and projecting radially outwardly therefrom.

15. A container according to claim 1, including means mounted in said outer shell for releasing abnormal pressures generated therewithin under accidental extreme elevated temperatures.

* * * * *